US006789891B2

(12) United States Patent
Wang et al.

(10) Patent No.: US 6,789,891 B2
(45) **Date of Patent: *Sep. 14, 2004**

(54) INK JET PRINTING METHOD

(75) Inventors: Xiaoru Wang, Rochester, NY (US); Hwei-Ling Yau, Rochester, NY (US); Wendy S. Krzemien, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/011,492

(22) Filed: Dec. 4, 2001

(65) Prior Publication Data

US 2003/0112310 A1 Jun. 19, 2003

(51) Int. Cl.[7] ..... B41M 5/00

(52) U.S. Cl. ..... 347/105; 428/32.24; 428/32.26; 428/32.36

(58) Field of Search ..... 347/105, 106; 428/32.24, 32.26, 32.36, 195, 323, 327, 32.2

(56) References Cited

FOREIGN PATENT DOCUMENTS

EP 0 858 905 A1 8/1998

*Primary Examiner*—Pamela R. Schwartz
(74) *Attorney, Agent, or Firm*—Harold E. Cole

(57) ABSTRACT

An ink jet printing method, having the steps of: A) providing an ink jet printer that is responsive to digital data signals; B) loading the printer with an ink jet recording element having a support having thereon a fusible, porous, image-receiving layer of non-porous polymeric particles having a core/shell structure of a polymeric, hydrophobic core covered with a polymeric, hydrophobic shell, the Tg of the polymeric, hydrophobic core being at least about 25° C. higher than the Tg of the polymeric, hydrophobic shell; C) loading the printer with an ink jet ink composition of water, a humectant, and a water-soluble dye; and D) printing on the overcoat layer using the inkjet ink in response to the digital data signals.

20 Claims, No Drawings

INK JET PRINTING METHOD

CROSS REFERENCE TO RELATED APPLICATIONS

Reference is made to commonly assigned, co-pending U.S. patent application Ser. No. and Patents: 09/607,417 by Kapusniak et al, filed Jun. 30, 2000 (U.S. Pat. No. 6,380,280, issued Apr. 30, 2002); 09/608,969 by Missell et al, filed Jun. 30, 2000 (U.S. Pat. No. 6,492,006, issued Dec. 10, 2002); and 10/011,427 by Yau et al, filed Dec. 4, 2001.

FIELD OF THE INVENTION

The present invention relates to an inkjet printing method using a porous ink jet recording element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by cast coating, in which a particulate-containing coating is applied to a support and is dried in contact with a polished smooth surface.

Inkjet prints, prepared by printing onto inkjet recording elements, are subject to environmental degradation. They are especially vulnerable to damage resulting from contact with water and atmospheric gases such as ozone. The damage resulting from the post imaging contact with water can take the form of water spots resulting from deglossing of the top coat, dye smearing due to unwanted dye diffusion, and even gross dissolution of the image recording layer. Ozone bleaches inkjet dyes resulting in loss of density. To overcome these deficiencies ink jet prints are often laminated. Lamination is however expensive as it requires a separate roll of material. Alternatively inkjet recording elements having a two-layer construction have been employed. These elements typically have a porous ink-transporting topcoat of thermally fusible particles residing on either a swellable or porous ink-retaining layer. Upon printing the ink passes through the topcoat and into an ink-retaining layer. The topcoat layer is then sealed to afford a water and stain resistant print. Such topcoats containing thermally fusible particles typically either, contain a binder or are thermally sintered to provide a level of mechanical integrity to the layer prior to the imaging and fusing steps.

Print protection can also be provided by coating a polymer solution or dispersion on the surface of an inkjet media after image is formed. The aqueous coating solutions are often polymer dispersions capable of film-formation when water is removed.

EP 0858905 A1 relates to the preparation of a recording medium comprising a porous outermost layer by coating and drying a particulate thermoplastic resin above its glass transition temperature (Tg), but below its minimum film formation temperature (MFFT). There is a problem with the element in that the drying temperature has to be controlled very precisely between the Tg and MFFT in order to achieve the desired result. If the drying temperature is below the Tg, then a powdery layer is formed. If the drying temperature is above MFFT, then a complete coalesced film is formed which will not transport ink.

It is an object of this invention to provide an inkjet printing method using a porous ink jet recording element that, when printed with an ink jet ink, provides an image which has good quality and is water and abrasion resistant. It is another object of the invention to provide an ink jet printing method using a porous ink jet recording element, which is easy to manufacture and is flexible after printing and fusing to provide resistance to cracking.

SUMMARY OF THE INVENTION

These and other objects are achieved in accordance with the invention which comprises an ink jet printing method, comprising the steps of:

A) providing an ink jet printer that is responsive to digital data signals;

B) loading the printer with an inkjet recording element comprising a support having thereon a fusible, porous, image-receiving layer comprising non-porous polymeric particles having a core/shell structure comprising a polymeric, hydrophobic core covered with a polymeric, hydrophobic shell, the Tg of the polymeric, hydrophobic core being at least about 25° C. higher than the Tg of the polymeric, hydrophobic shell;

C) loading the printer with an ink jet ink composition comprising water, a humectant, and a water-soluble dye; and D) printing on the overcoat layer using the ink jet ink in response to the digital data signals.

By use of the printing method of the invention, a porous ink jet recording element is obtained that, when printed with an ink jet ink, has good abrasion and water-resistance, and is flexible after printing and fusing to provide resistance to cracking.

DETAILED DESCRIPTION OF THE INVENTION

The non-porous polymeric particles, which are used in the invention, comprise a polymeric core covered with a shell of a water-insoluble polymer.

Polymers which can be used as a core and a shell for the core/shell particles used in the invention comprise, for example, acrylic resins, styrenic resins, or cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, polyvinyl acetal, ethylene-vinyl acetatecopolymers, ethylene-vinyl alcohol copolymers, and ethylene-allyl copolymers such as ethylene-allyl alcohol copolymers, ethylene-allyl acetone copolymers, ethylene-allyl benzene copolymers, ethylene-allyl ether copolymers, ethylene acrylic copolymers and polyoxy-methylene; polycondensation polymers, such as, polyesters, including polyethylene terephthalate, polybutylene terephthalate, polyurethanes and polycarbonates.

In a preferred embodiment of the invention, the polymeric core and the polymeric shell are made from a styrenic or an acrylic monomer. Any suitable ethylenically unsaturated monomer or mixture of monomers may be used in making such styrenic or acrylic polymer. There may be used, for example, styrenic compounds, such as styrene, vinyl toluene, p-chlorostyrene, vinylbenzylchloride or vinyl naphthalene; or acrylic compounds, such as methyl acrylate, ethyl acrylate, n-butyl acrylate, n-octyl acrylate, 2-chloroethyl acrylate, phenyl acrylate, methyl-α-chloroacrylate, methyl methacrylate, ethyl methacrylate, butyl methacrylate; and mixtures thereof. In another preferred embodiment, methyl methacrylate or styrene is used.

Core-shell particles employed in this invention are in general prepared by a sequential emulsion polymerization technique. The core polymer latex is polymerized first followed by the sequential feeding of the second monomer emulsions to form a core-shell structure. Examples of core-shell particle preparation can be found in "Emulsion Polymerization and Emulsion Polymers", P. A. Lovell and M. S. El-Aasser, John Wiley & Sons, Ltd., 1997.

In a preferred embodiment of the invention, the Tg of the polymeric hydrophobic core is from about 50° C. to about 200° C. In another embodiment, the Tg of the polymeric hydrophobic shell is from about −60° C. to about 125° C. In still another preferred embodiment, the particles having a core/shell structure have an average particle size of from about 0.05 μm to about 10 μm. In yet still another preferred embodiment, the particles having a core/shell structure have a weight ratio of the core to the shell of from about 1:10 to about 1:0.1. In yet another preferred embodiment, the particles having a core/shell structure have a polydispersity index of particle size distribution of less than about 1.3.

If desired, a suitable crosslinking monomer may be used in forming the polymeric core in order to modify the non-porous polymeric particle to produce particularly desired properties. Typical crosslinking monomers are aromatic divinyl compounds such as divinylbenzene, divinylnaphthalene or derivatives thereof; diethylene carboxylate esters and amides such as ethylene glycol dimethacrylate, diethylene glycol diacrylate, and other divinyl compounds such as divinyl sulfide or divinyl sulfone compounds. Divinylbenzene and ethylene glycol dimethacrylate are especially preferred. While the crosslinking monomer may be used in any amount, at least about 27 mole % is preferred.

If desired, UV absorbing monomers may be used in forming the polymeric core or polymeric shell in order to improve light fastness of the image. Examples of UV absorbing monomers that can be used include the following:

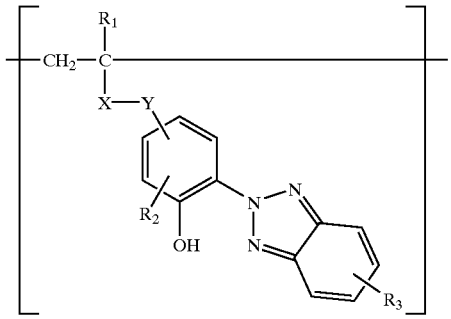

| UV-Absorber | $R_1$ | $R_2$ | $R_3$ | X | Y |
|---|---|---|---|---|---|
| UV-1 | $CH_3$ | H | H | COO | $(CH_2)_2$ |
| UV-2 | H | H | Cl | COO | $(CH_2)_3$ |
| UV-3 | H | H | H | 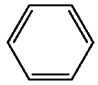 | $CH_2O$ |

The non-porous polymeric particles used in this invention have a polymeric core that can be prepared, for example, by pulverizing and classification of organic compounds, by emulsion, suspension, and dispersion polymerization of organic monomers, by spray drying of a solution containing organic compounds, or by a polymer suspension technique which consists of dissolving an organic material in a water immiscible solvent, dispersing the solution as fine liquid droplets in aqueous solution, and removing the solvent by evaporation or other suitable techniques. The bulk, emulsion, dispersion, and suspension polymerization procedures are well known to those skilled in the polymer art and are taught in such textbooks as G. Odian in "Principles of Polymerization", 2nd Ed. Wiley (1981), and W. P. Sorenson and T. W. Campbell in "Preparation Method of Polymer Chemistry", 2nd Ed, Wiley (1968).

As noted above, the polymeric particles used in the invention are non-porous. By non-porous is meant a particle that is either void-free or not permeable to liquids. These particles can have either a smooth or a rough surface.

The image-receiving layer may also contain additives such as pH-modifiers like nitric acid, rheology modifiers, surfactants, UV-absorbers, biocides, lubricants, water-dispersible latexes, mordants, dyes, optical brighteners etc.

The image-receiving layer may be applied to one or both substrate surfaces through conventional pre-metered or post-metered coating methods such as blade, air knife, rod, roll, slot die, curtain, slide, etc. The choice of coating process would be determined from the economics of the operation and in turn, would determine the formulation specifications such as coating solids, coating viscosity, and coating speed.

The image-receiving layer thickness may range from about 5 to about 100 μm, preferably from about 10 to about 50 μm. The coating thickness required is determined through the need for the coating to act as a sump for absorption of ink solvent.

Ink jet inks used to image the recording elements employed in the present invention are well-known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

In another embodiment of the invention, an ink-retaining layer is present between the support and the image-receiving layer and is preferably continuous and coextensive with the fusible, porous, image-receiving layer. In a preferred embodiment of the invention, the continuous, coextensive, ink-retaining layer is porous and contains organic or inorganic particles. Examples of organic particles which may be used include core/shell particles such as those disclosed in U.S. Ser. No. 09/609/969 of Kapusniak et al., filed Jun. 30, 2000, and homogeneous particles such as those disclosed in U.S. Ser. No. 09/608/466 of Kapusniak et al., filed Jun. 30, 2000, the disclosures of which are hereby incorporated by reference. Examples of organic particles that may be used include acrylic resins, styrenic resins, cellulose derivatives, polyvinyl resins, ethylene-allyl copolymers and polycondensation polymers such as polyesters. Examples of inorganic particles that may be used in the invention include silica, alumina, titanium dioxide, clay, calcium carbonate, barium sulfate, or zinc oxide.

In a preferred embodiment of the invention, the porous ink-retaining layer comprises from about 20% to about 100% of particles and from about 0% to about 80% of a polymeric binder, preferably from about 50% to about 95% of particles and from about 5% to about 50% of a polymeric binder. The polymeric binder may be a hydrophilic polymer such as poly(vinyl alcohol), poly(vinyl pyrrolidone), gelatin, cellulose ethers, poly(oxazolines), poly(vinylacetamides), partially hydrolyzed poly(vinyl acetate/vinyl alcohol), poly (acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. Preferably, the hydrophilic polymer is poly(vinyl alcohol), hydroxypropyl cellulose, hydroxypropyl methyl cellulose, a poly(alkylene oxide), poly(vinyl pyrrolidinone), poly(vinyl acetate) or copolymers thereof or gelatin.

In a preferred embodiment of the invention, the ink-retaining layer has a thickness of about 1 $\mu$m to about 50 $\mu$m and the image-receiving layer has a thickness of about 2 $\mu$m to about 30 $\mu$m.

In order to impart mechanical durability to an ink jet recording element, crosslinkers that act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate and the like may be used. Preferably, the crosslinker is an aldehyde, an acetal or a ketal, such as 2,3-dihydroxy-1,4-dioxane.

During the ink jet printing process, ink droplets are rapidly absorbed into the porous coating through capillary action and the image is dry-to-touch right after it comes out of the printer. Therefore, porous coatings allow a fast "drying" of the ink and produces a smear-resistant image.

The porous ink-retaining layer can also comprise an open-pore polyolefin, an open-pore polyester or an open pore membrane. An open pore membrane can be formed in accordance with the known technique of phase inversion. Examples of a porous ink-retaining layer comprising an open-pore membrane are disclosed in U.S. Ser. No. 09/626/752 and U.S. Ser. No. 09/626/883, both of Landry-Coltrain et al., filed Jul. 27, 2000, the disclosure of which is hereby incorporated by reference.

The support used in the ink jet recording element employed in the invention may be opaque, translucent, or transparent. There may be used, for example, plain papers, resin-coated papers, various plastics including a polyester resin such as poly(ethylene terephthalate), poly(ethylene naphthalate) and poly(ester diacetate), a polycarbonate resin, a fluorine resin such as poly(tetra-fluoro ethylene), metal foil, various glass materials, and the like. In a preferred embodiment, the support is a resin-coated paper. The thickness of the support employed in the invention can be from about 12 to about 500 $\mu$m, preferably from about 75 to about 300 $\mu$m.

If desired, in order to improve the adhesion of the base layer to the support, the surface of the support may be corona-discharge-treated prior to applying the base layer or solvent-absorbing layer to the support.

Since the image recording element may come in contact with other image recording articles or the drive or transport mechanisms of image recording devices, additives such as surfactants, lubricants, matte particles and the like may be added to the element to the extent that they do not degrade the properties of interest. In addition, the top layer of the invention may also contain other additives such as viscosity modifiers or mordants.

The layers described above, including the base layer and the top layer, may be coated by conventional coating means onto a support material commonly used in this art. Coating methods may include, but are not limited to, wound wire rod coating, slot coating, slide hopper coating, gravure, curtain coating and the like. Some of these methods allow for simultaneous coatings of both layers, which is preferred from a manufacturing economic perspective.

Ink jet inks used to image the recording elements employed in the present invention are well-known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples are provided to illustrate the invention.

EXAMPLES

Example 1

Preparation of Polymer Particles

Synthesis of Control CP-1 Particles

A latex was prepared by an emulsion polymerization technique. 450 g of deionized water, 3.0 g of surfactant Triton 770® (30 wt. % solids), 1.0 g of initiator potassium persulfate, and 19 g of monomer methyl methacrylate were first charged to a 2L 3-neck flask equipped with a nitrogen inlet, mechanical stirrer and condenser. The flask was immersed in a constant temperature bath at 80° C. and purged with nitrogen for 20 min. An monomer emulsion was prepared by mixing 280 g of deionized water, 7.8 g of surfactant Triton 770®, 0.8 g of initiator potassium persulfate (KPS), 139 g of monomer methyl methacrylate (MMA) and 4.2 g of sodium 2-sulfo-1,1-dimethylethyl acrylamide (SSDMEAA) monomer. The monomer emulsion mixture was added to the flask with agitation. The addition time of the monomer emulsion was three hours. The polymerization was continued for one more hour after the addition of the monomer emulsion. The latex was cooled to room temperature and filtered. The final % solids was 18.77% and the particle size was 149 nm.

Synthesis of Control CP-2 Particles

To a 20-gallon, stainless-steel reactor was added 44 kg of demineralized water. The system was purged for 15–30 minutes with nitrogen. The temperature was set at 15° C. and the stirrer was set at 150 rev/min. The following were added to the reactor in order: 104.6 g potassium metabisulfite dissolved in 500 ml demineralized water, 421.9 g itaconic acid, 2109.5 g ethylacrylate, 18.56 kg of vinylidene chloride, 469 g of Dowfax® 2EP rinsed in with 1 kg demineralized water, and 104.6 g potassium persulfate dissolved in 1.5 kg demineralized water. The reactor port and the vent were closed. The reactor was pressurised to 2 psi with nitrogen. The internal temperature was set to 40° C., and held there for 16–20 hours. The product was then cooled to 20° C., and the vacuum was broken with nitrogen. The product was filtered through cheesecloth.

Synthesis of Control CP-3 Particles

A latex was prepared by an emulsion polymerization technique similarly to the synthesis described above. 260 g of deionized water, 3.0 g of surfactant Triton 770®, 1.0 g of initiator potassium persulfate, and 10 g of monomer methyl methacrylate were first charged to a 2L 3-neck flask equipped with a nitrogen inlet, mechanical stirrer and condenser. The flask was immersed in a constant temperature bath at 80° C. and purged with nitrogen for 20 min. A monomer emulsion was prepared by mixing 100 g of deionized water, 7.8 g of surfactant Triton 770®, 0.8 g of initiator potassium persulfate, 31 g of monomer methyl methacrylate and 122 g of butyl methacrylate monomer. The monomer emulsion mixture was added to the flask with agitation. The addition time of the monomer emulsion was three hours. The polymerization was continued for one more hour after the addition of the monomer emulsion. The latex was cooled to room temperature and filtered. The final % solids was 32.9% and the particle size was 122.0 nm.

Synthesis of P-1 Particles (Invention)

The core-shell latex employed in this invention was prepared by a sequential emulsion polymerization technique. In general, the core polymer latex is polymerized first followed by the sequential feeding of the second monomer emulsions. A typical synthetic procedure of the core-shell latex of this invention is described below. The following ingredients were used for the preparation of P-1 particles of this invention.

A: Deionized water (50 g) Triton 770® (30% active) (0.4 g)

B: Potassium persulfate (0.12 g)

C: Methyl methacrylate (17.1 g) Sodium 2-sulfo-1,1-dimethylethyl acrylamide (0.9 g) Potassium persulfate (0.1 g) Triton 770® (30% active) (0.9 g) Deionized water (35 g)

D: Ethyl acrylate (3.6 g) Vinylidene chloride (31.0 g) Sodium 2-sulfo-1,1-dimethylethyl acrylamide (1.44 g) Potassium persulfate (0.21 g) Sodium bisulfate (0.42 g) Triton 770® (30% active) (5.80 g) Deionized water (160 g)

1. (A) was first charged to a 1L 3-neck flask equipped with a nitrogen inlet, mechanical stirrer and condenser. The flask was immersed in a constant temperature bath at 80° C. and purged with nitrogen for 20 min.
2. (B) was added and followed by the addition of monomer emulsion (C). The mixture was agitated all the time during the feeding of monomer emulsion. The addition time of the monomer emulsion (C) was two hours.
3. The polymerization was continued for 30 min after the addition of the first monomer emulsion and the latex was cooled to 40° C.
4. The second monomer emulsion (D) was prepared in the same way. The total addition time was two hours.
5. The latex was heated at 40° C. for one hour.
6. 4 ml of 10% t-butyl hydroperoxide and 10% formaldehyde-sulfite were added to remove the residual monomer and held for 30 min.
7. The mixture was cooled to room temperature and filtered.

Glass Transition Temperature Measurement

The glass transition temperature (Tg) of the dry polymer materials was determined by differential scanning calorimetry (DSC), using a heating rate of 20° C./minute, and shown in Table 1 below. Tg is defined herein as the inflection point of the glass transition.

Particle Size Measurement

Particles were characterized by a 90 plus Particle Sizer manufactured by Brookhaven Instruments Corporation. The volume mean diameters are reported.

The properties of the polymer particles used in the examples are shown in Table 1 as follows:

TABLE 1

| Particle | Core composition (wt. %) and Tg [° C.] | Shell composition (wt. %) and Tg [° C.] | Wt. ratio of core:shell | Average Particle Size |
|---|---|---|---|---|
| CP-1 | MMA/SSDMEAA (95/5) [120] | None | | 180 nm |
| CP-2 | EA/VC/IA (10/88/2) [9] | None | | 70 nm |
| CP-3 | MMA/BMA (25/75) [51] | None | | 109 nm |
| P-1 | MMA/SSDMEAA (95/5) [120] | EA/VC/SSDMEAA (10/86/4) [12] | 1:2 | 117 nm |

MMA = methyl methacrylate
BMA = butyl methacrylate
EA = ethyl acrylate
SSDMEAA = sodium 2-sulfo-1,1-dimethylethyl acrylamide
VC = vinylidene cholride Preparation of Control Element C-1 (no fusible overcoat)

A 2-layer porous glossy ink jet media on a polyethylene-coated paper was prepared. The bottom layer consisted of fumed alumina, Cab-O-Sperse PG003®, (Cabot Corp.), polyvinyl alcohol, GH-23, (Nippon Ghosei) and 2,3-dihydroxy-1,4-dioxane (Clariant Corp.) at a weight ratio of 87:9:4 and a thickness of 38 $\mu$m. The top layer consisted of fumed alumina, Cab-O-Sperse PG003®, (Cabot Corp.), polyvinyl alcohol, GH-23, (Nippon Ghosei), surfactant Zonyl FSN® (DuPont Corp.) and dye mordanting material MM at a weight ratio of 69:6:5:20 and a thickness of 2 $\mu$m. MM was a crosslinked hydrogel polymer particle of 80 nm in average particle size prepared from 87% by weight of N-vinylbenzyl-N,N,N-trimethylammonium chloride and 13% by weight of divinylbenzene.

Preparation of Control Element C-2

Control Element C-1 was further coated with an aqueous dispersion comprising polymer particle CP-1 and dried at 25° C. for 3 minutes followed by 40° C. for another 3 minutes with forced air circulation. A small amount of a nonionic surfactant, Olin 10 G®, used at 0.1% to 4% based on the total dry laydown of the layer, was used in the coating solution to control the surface tension during coating.

Preparation of Control Element C-3

This element was prepared similar to C-2, except polymer particle CP-2 was used.

Preparation of Control Element C-4

This element was prepared similar to C-2, except polymer particle CP-3 was used.

Preparation of Control Element C-5

This element was prepared similar to C-2, except a mixture of polymer particles CP-1 and CP-2 at 50/50 weight ratio was used.

Preparation of Element 1 of the Invention

This element was prepared similar to C-2, except polymer particle P-1 was used.

Ink Absorption

Inkjet samples were loaded in Hewlett-Packard DeskJet 950° C. printer and printed with a pre-assembled digital image of color patches and pictures. The printed sample was immediately rubbed by a finger on heavily inked areas as it was ejected from the printer. Instant dry is defined as the print was dry to the touch and the image was not smudged or damaged by the finger-rubbing action. If the particles coalesced and formed a continuous film on drying after coating, ink would form droplets on the surface and not penetrate through the layer; the image would be low in optical density and easily smudged by rubbing.

Fusing

The printed samples were fused between a set of heated pressurized rollers, at least one of which was heated at a temperature of 157° C. and a speed of 2.5 cm per second.

Test for Water and Stain Resistance

Ponceau red dye solution was prepared by dissolving 1 g of dye in 1000 grams mixture of acetic acid and water (5 parts: 95 parts). An approximately 1 cm-diameter Ponceau Red dye solution was placed on the sample surface for 5 minutes. The liquid was then wiped up with a Sturdi-Wipes paper towel. A visual observation of the tested area was made and recorded. No mark of dye stain left on the image indicates the existence of a water resistant overcoat layer; a red stain on the image indicates no existence of a water resistant overcoat layer.

Test for Flexibility of Fused Overcoat

Fused samples were wrapped around a rod 0.65 cm in diameter with the overcoat layer on the outside. Samples were then tested with Ponceau red dye solution as described above in the bent area. Lines of red dye stain indicate that the overcoat was brittle and cracked when bent; no stain indicates that the overcoat was flexible.

Elements 1–2 to 1–6 were prepared by coating particles on Control Element C-1 to achieve the dry laydown of 7.6 g/m$^2$. The performance of inkjet media of this invention in comparison with ink jet media without fusible core-shell particles or ink jet media with single-composition (non core-shell) particles are summarized in Table 2 below.

TABLE 2

| Element | Description | Appearance | Ink Absorption | Stain Resistance | Overcoat Flexibility |
|---|---|---|---|---|---|
| C-1 | No overcoat | Glossy | Instant dry | None | |
| C-2 | CP-1 as overcoat | Powdery, particles were easily rubbed off | Instant dry | Yes | No, cracks formed |
| C-3 | CP-2 as overcoat | Glossy | Not ink absorptive | Yes | Yes |
| C-4 | CP-3 as overcoat | Powdery, particles were easily rubbed off | Instant dry | Yes | No, cracks formed |
| C-5 | Mixture of CP-1 and CP-2 (50%/50%) as overcoat | Glossy | Not ink absorptive | Yes | Yes |
| 1 | P-1 as overcoat | Glossy | Instant dry | Yes | Yes |

The above results show that the overcoat layer on Element 1 employed in the printing process of the invention had better cohesive integrity before fusing, fast ink absorption and was fusible after printing to give print protection as compared to the control elements.

Example 2

Synthesis of P-2 through P-4 Particles (Invention)

These particles were prepared the same as P-1 in Example 1, except using different polymer compositions as shown in Table 3 as follows:

TABLE 3

| Particle | Core composition (wt. %) and Tg [° C.] | Shell composition (wt. %) and Tg [° C.] | Wt. ratio of core:shell | Average Particle Size (nm) |
|---|---|---|---|---|
| P-2 | MMA/EGDM/SSDMEAA (93/2/5) [125] | EA/VC/SSDMEAA (10/86/4) [12] | 1:2 | 158 |
| P-3 | EMA/EGDM (98/2) [70] | EA/VC/NaAMPS (10/84/6) [12] | 1:1 | 136 |
| P-4 | EMA/EGDM (98/2) [70] | EA/VC(10/90) [10] | 1:1.5 | 161 |

MMA = methyl methacrylate
EA = ethyl acrylate
EMA = ethyl methacrylate
EGDM = ethylene glycol dimethylacrylate
SSDMEAA = sodium 2-sulfo-1,1-dimethylethyl acrylamide
VC = vinylidene cholride Preparation of Control Element C-6 (no fusible overcoat)

This element was prepared similar to control element C-1 except the top layer was omitted.

Preparation of Control Element C-7 (no fusible overcoat)

A 2-layer porous glossy ink jet media on a polyethylene-coated paper was prepared. The bottom layer was prepared by coating a solution mixture of AQ29 (available from Eastman Chemical Co.) and Borax at a 50/50 dry weight ratio to achieve a total dry laydown of 3.8 g/m$^2$. The pH of the coating solution was adjusted to 7.0 prior to coating. The top layer was coated from a solution mixture of polyvinyl alcohol, organic porous particles described below and Olin 10G to achieve a dry laydown of 29.8 g/m$^2$, 4.5 g/m$^2$ and 0.11 g/m$^2$ respectively.

Preparation of Organic Porous Particles

To a beaker were added the following ingredients: 200 g ethyleneglycol dimethacrylate as monomer, 188 g toluene as a porogen, 12 g hexadecane, and 3.0 g 2,2'-azobis(2,4-dimethylvaleronitrile) (Vazo 52®, from DuPont Corp.). The ingredients were stirred until all the solids were dissolved.

To this solution was added a mixture of 12 g sodium dodecylbenzenesulfonate in 1200 g water. The mixture was then stirred with a marine prop type agitator for 5 minutes to form a crude emulsion. The crude emulsion was passed once through a Gaulin® homogenizer at 4000 psi. The resulting monomer droplet dispersion was placed into a 2-liter three-necked round bottom flask. The flask was placed in a 50° C. constant temperature bath and the dispersion stirred under positive pressure nitrogen for 16 hours to polymerize the monomer droplets into organic porous particles. The product was filtered through a coarse filter to remove coagulum. Next, 0.3 g MAZU® antifoam agent (BASF Corp.) was added to the dispersion and toluene and some water were distilled off under vacuum at 50° C. to give 18.3% solids. The organic porous particles were measured by a particle size analyzer, Horiba LA-920®, and found to be 0.38 $\mu$m in median diameter.

Preparation of Control Element C-8 (no fusible overcoat)

This element was prepared by coating a solution mixture of barium sulfate particles, polyvinyl alcohol, 2,3-dihydroxy-1,4-dioxane (Clariant Corp.) and Olin 10G (Olin) on a polyethylene-coated paper to achieve a final dry laydown of 53.8 g/m$^2$, 8.0 g/m$^2$, 0.4 g/m$^2$ and 0.11 g/m$^2$ respectively. The barium sulfate particles, identified as Sachtosperse HU-N, was obtained from Sachtleben Chemie Corporation; it is pure precipitated BaSO4 with an average particle size of less than 0.1 um and specific surface area >25 m$^2$/g. The polyvinyl alcohol used in this element was GH-17, available from Nippon Gohsei Chemical.

Preparation of Control Element C-9 (no fusible overcoat)

A plain paper support with basis weight of 185 g/m$^2$ (Eastman Kodak Co.) was used.

Preparation of Control Element C-10 (no fusible overcoat)

A two-layer coating on plain paper was prepared as follows. The coating solution for the base layer was prepared by mixing 254 dry g of precipitated calcium carbonate Albagloss-s® (Specialty Minerals Inc.) as a 70% solution, 22 dry g of silica gel Gasil® 23F (Crosfield Ltd.), 2.6 dry g of poly(vinyl alcohol) Airvol® 125 (Air Products) as a 10% solution, 21 dry g of styrene-butadiene latex CP692NA® (Dow Chemical Co.) as a 50% solution and 0.8 g of Alcogum® L-229 (Alco Chemical Co.). The concentration of the coating solution was adjusted to 35 wt. % by adding water. The coating solution was bead-coated at 25° C. on a plain paper support with basis weight of 185 g/m$^2$ (Eastman Kodak Co.) and dried by forced air at 45° C. The thickness of the base layer was 25 $\mu$m or 27 g/m$^2$.

The coating solution for the top layer was prepared by mixing 15.0 dry g of alumina Dispal® 14N4-80 (Condea Vista) as a 20 wt. % solution, 2.4 dry g of fumed alumina Cab-O-Sperse® PG003 (Cabot Corp.) as a 40 wt. % solution, 0.6 dry g of poly(vinyl alcohol) Gohsenol® GH-17 (Nippon Gohsei Co. Ltd.) as a 10 wt. % solution, 1.2 dry g of a copolymer of (vinylbenzyl)trimethylammonium chloride and divinylbenzene (87:13 molar ratio) as a 20 wt. % solution, 1.2 dry g of a terpolymer of styrene, (vinylbenzyl) dimethylbenzylamine and divinylbenzene (49.5:49.5:1.0 molar ratio) as a 20 wt. % solution, 0.9 dry g of Encapsulated Particles 1 as a 40 wt. % solution, 0.1 g of Silwet® L-7602 (Witco. Corp.), 0.2 g of Zonyl® FS300 (DuPont Co.) and water to total 153 g. The preparation of Encapsulated Particles 1 is disclosed in Example 1 of U.S. Ser. No. 09/944,547, of Sadasivan et al. filed Aug. 31, 2001, the disclosure of which is hereby incorporated by reference. The coating solution was bead-coated at 25° C. on top of the base layer described above. The recording element was then dried by forced air at 45° C. for 80 seconds followed by 38° C. for 8 minutes. The thickness of the image-receiving layer was 8 $\mu$m or 8.6 g/m$^2$.

Preparation of Control Elements C-11 Through C-16

Control Elements C-1 and C-6 through C-10 were further coated with an aqueous dispersion comprising polymer particle CP-3 used in Example 1 and dried at 25° C. for 3 minutes followed by 40° C. for another 3 minutes with forced air circulation to achieve a dry laydown of 7.6 g/m$^2$. A small amount of a nonionic surfactant, Olin 10 G®, used at 0.1% to 4% based on the total dry laydown of the layer, was used in the coating solution to control the surface tension during coating.

Preparation of Elements 2 Through 7 of This Invention

These elements were prepared the same as C-11 through C-16, except core-shell particle P-2 was used.

Preparation of Elements 8 Through 13 of This Invention

These elements were prepared the same as C-11 through C-16, except core-shell particle P-3 was used.

Preparation of Elements 14 Through 19 of This Invention

These elements were prepared the same as C-11 through C-16, except core-shell particle P-4 was used.

Ink Absorption and Fusing

These elements were printed and fused as in Example 1. The following results were obtained:

TABLE 4

| Element | Description | Appearance | Ink Absorption | Stain Resistance | Overcoat Flexibility |
|---|---|---|---|---|---|
| C-1 | No overcoat | | Instant dry | None | |
| C-6 | No overcoat | | Instant dry | None | |
| C-7 | No overcoat | | Instant dry | None | |
| C-8 | No overcoat | | Instant dry | None | |
| C-9 | No overcoat | | Instant dry | None | |
| C-10 | No overcoat | | Instant dry | None | |
| C-11 | Particle CP-3 on C-1 | Powdery surface | Instant dry | Yes | No, cracked |
| C-12 | Particle CP-3 on C-6 | Powdery surface | Instant dry | Yes | No, cracked |
| C-13 | Particle CP-3 on C-7 | Powdery surface | Instant dry | Yes | No, cracked |
| C-14 | Particle CP-3 on C-8 | Powdery surface | Instant dry | Yes | No, cracked |
| C-15 | Particle CP-3 on C-9 | Powdery surface | Instant dry | Yes | No, cracked |
| C-16 | Particle CP-3 on C-10 | Powdery surface | Instant dry | Yes | No, cracked |
| 2 | Particle P-2 on C-1 | Glossy and not powdery | Instant dry | Yes | Yes, no cracks formed |
| 3 | Particle P-2 on C-6 | Glossy and not powdery | Instant dry | Yes | Yes, no cracks formed |
| 4 | Particle P-2 on C-7 | Glossy and not powdery | Instant dry | Yes | Yes, no cracks formed |
| 5 | Particle P-2 on C-8 | Glossy and not powdery | Instant dry | Yes | Yes, no cracks formed |
| 6 | Particle P-2 on C-9 | Glossy and not powdery | Instant dry | Yes | Yes, no cracks formed |
| 7 | Particle P-2 on C-10 | Glossy and not powdery | Instant dry | Yes | Yes, no cracks formed |

TABLE 4-continued

| Element | Description | Appearance | Ink Absorption | Stain Resistance | Overcoat Flexibility |
|---|---|---|---|---|---|
| 8 | Particle P-3 on C-1 | Glossy and not powdery | Instant dry | Yes | Yes, no cracks formed |
| 9 | Particle P-3 on C-6 | Glossy and not powdery | Instant dry | Yes | Yes, no cracks formed |
| 10 | Particle P-3 on C-7 | Glossy and not powdery | Instant dry | Yes | Yes, no cracks formed |
| 11 | Particle P-3 on C-8 | Glossy and not powdery | Instant dry | Yes | Yes, no cracks formed |
| 12 | Particle P-3 on C-9 | Glossy and not powdery | Instant dry | Yes | Yes, no cracks formed |
| 13 | Particle P-3 on C-10 | Glossy and not powdery | Instant dry | Yes | Yes, no cracks formed |
| 14 | Particle P-4 on C-1 | Glossy and not powdery | Instant dry | Yes | Yes, no cracks formed |
| 15 | Particle P-4 on C-6 | Glossy and not powdery | Instant dry | Yes | Yes, no cracks formed |
| 16 | Particle P-4 on C-7 | Glossy and not powdery | Instant dry | Yes | Yes, no cracks formed |
| 17 | Particle P-4 on C-8 | Glossy and not powdery | Instant dry | Yes | Yes, no cracks formed |
| 18 | Particle P-4 on C-9 | Glossy and not powdery | Instant dry | Yes | Yes, no cracks formed |
| 19 | Particle P-4 on C-10 | Glossy and not powdery | Instant dry | Yes | Yes, no cracks formed |

The above results show that the overcoat layer on the elements employed in the process of the invention had better cohesive integrity before fusing, fast ink absorption and was fusible after printing to give print protection as compared to the control elements.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet printing method, comprising the steps of:

A) providing an ink jet printer that is responsive to digital data signals;

B) loading said printer with an ink jet recording element comprising a support having thereon a fusible, porous, image-receiving layer comprising non-porous polymeric particles having a core/shell structure comprising a polymeric, hydrophobic core covered with a polymeric, hydrophobic shell, the Tg of said polymeric, hydrophobic core being at least about 25° C. higher than the Tg of said polymeric, hydrophobic shell;

C) loading said printer with an ink jet ink composition comprising water, a humectant, and a water-soluble dye;

D) printing on said image-receiving layer using said ink jet ink in response to said digital data signals; and E) fusing said image-receiving layer.

2. The method of claim 1 wherein the Tg of said polymeric hydrophobic core is from about 50° C. to about 200° C.

3. The method of claim 1 wherein the Tg of said polymeric hydrophobic shell is from about −60° C. to about 125° C.

4. The method of claim 1 wherein there is an ink-retaining layer between said support and said image-receiving layer.

5. The method of claim 4 wherein said ink-retaining layer has a thickness of about 1 μm to about 50 μm and said image-receiving layer has a thickness of about 2 μm to about 30 μm.

6. The method of claim 4 wherein said ink-retaining layer is continuous, coextensive and porous.

7. The method of claim 6 wherein said ink-retaining layer comprises from about 20% to about 100% of particles and from about 0% to about 80% of a polymeric binder.

8. The method of claim 7 wherein said particles comprise silica, alumina, titanium dioxide, clay, calcium carbonate, barium sulfate or zinc oxide.

9. The method of claim 7 wherein said polymeric binder is poly(vinyl alcohol), hydroxypropyl cellulose, hydroxypropyl methyl cellulose, a poly(alkylene oxide), poly(vinyl pyrrolidinone), poly(vinyl acetate) or copolymers thereof, or gelatin.

10. The method of claim 6 wherein said porous ink-retaining layer comprises from about 50% to about 95% of particles and from about 5% to about 50% of a polymeric binder.

11. The method of claim 6 wherein said porous ink-retaining layer contains organic particles.

12. The method of claim 6 wherein said continuous, coextensive, porous ink-retaining layer has interconnecting voids comprising a polymeric open-pore membrane.

13. The method of claim 1 wherein said image-receiving layer has a thickness of about 5 μm to about 100 μm.

14. The method of claim 1 wherein said support is resin-coated paper.

15. The method of claim 1 wherein said particles having a core/shell structure have an average particle size of from about 0.05 μm to about 10 μm.

16. The method of claim 1 wherein said particles having a core/shell structure have a weight ratio of said core to said shell of from about 1:10 to about 1:0.1.

17. The method of claim 1 wherein said particles having a core/shell structure have a core which is cross-linked.

18. The method of claim 1 wherein said particles having a core/shell structure have a polydispersity index of particle size distribution of less than about 1.3.

19. The method of claim 1 wherein said polymeric, hydrophobic core contains a UV-absorbing material.

20. The method of claim 1 wherein said polymeric, hydrophobic shell contains a UV-absorbing material.

* * * * *